United States Patent [19]

Christianson

[11] Patent Number: 4,877,022

[45] Date of Patent: Oct. 31, 1989

[54] SKIN DIVING SNORKEL

[76] Inventor: Tony Christianson, 277 Grulla Ct., Norco, Calif. 91760

[21] Appl. No.: 292,225

[22] Filed: Dec. 30, 1988

[51] Int. Cl.[4] ..... B63C 11/16

[52] U.S. Cl. ..... 128/201.11; 272/DIG. 1

[58] Field of Search ..... 128/201.11, 201.27, 128/201.28, 205.24, 205.25; 137/41; 272/1 B, DIG. 1; 273/1 L

[56] References Cited

U.S. PATENT DOCUMENTS

| | | | |
|---|---|---|---|
| 2,317,236 | 4/1943 | Wilen et al. | 128/201.11 |
| 2,362,775 | 11/1944 | Sebouh | 128/201.11 |
| 2,408,166 | 9/1946 | Hawkins | 128/201.11 |
| 2,931,057 | 4/1960 | Vilarem | 128/201.11 |
| 4,071,024 | 1/1978 | Blanc et al. | 128/201.11 |
| 4,278,080 | 7/1981 | Schuch | 128/201.11 |
| 4,610,246 | 3/1985 | Delphia | 128/201.11 |
| 4,708,135 | 11/1987 | Arkema | 128/201.11 |
| 4,793,341 | 12/1988 | Arasmith | 128/201.11 |
| 4,805,610 | 2/1989 | Hunt | 128/201.11 |

*Primary Examiner*—Eugene H. Eickholt

[57] ABSTRACT

The present invention is an improved skin diving snorkel having a conduit with an unobstructed, open end above water and an underwater end which terminates in a chamber. The chamber houses a normally closed float valve in series with an outwardly directed purge valve. The purge valve allows water in the snorkel to flow to ambient when hydrostatic pressure within the snorkel is greater than ambient. The chamber also serves to accumulate water which drains down the conduit after a purging exhalation or after splashing in the open end. A mouthpiece adjacent and above the chamber provides a flow path from the conduit to the interior of the diver's mouth.

The float valve opens when the chamber is flooded with water. Consequently, water in the snorkel which extends above the ambient water surface will drain through the purge valve, decreasing the amount of water remaining within the snorkel to be purged. The float valve blocks flow through the purge valve when the chamber is emptied of water during a purging exhalation, preventing the wasteful loss of purging air. Water which accumulates in the chamber between purges is eliminated when the snorkel is next purged.

15 Claims, 5 Drawing Sheets

SKIN DIVING SNORKEL

BACKGROUND OF THE INVENTION

1. Field of the Invention

The present invention is generally related to snorkels used by skin divers. More particularly, this invention is related to devices for purging water from a flooded snorkel.

2. Description of the Prior Art

Skin divers use the snorkel as a means to breathe while swimming face down on the water surface. The snorkel functions as a conduit between the diver's mouth and the overhead air. Typically, when in use, the open end of the snorkel conduit extends a short distance above the water surface. Occasionally, due to swimming movements or wave action, small amounts of water flow into the open end of the snorkel and partially flood the conduit. Also, water will flood the snorkel when the diver swims or dives below the water surface. An experienced skin diver can sense when water enters the snorkel and responds by immediately stopping inhalation. Respiration is resumed after the snorkel has been purged of water.

Inexperienced skin divers find occasional flooding especially troublesome because, undetected, water can be inhaled resulting in coughing and extreme discomfort. Consequently, several designs have been proposed to restrict or block the normally open end of the snorkel and thereby prevent water from entering.

U.S. Pat. No. 4,071,024 entitled Snorkel, issued to Max A. Blanc on Jan. 31, 1978, teaches an air entrapping cap which is mounted on the above water opening of the snorkel. A tortuous passage in the cap retards water flow into the snorkel. Although such a cap is somewhat effective in blocking the occasional flow of surface water into the snorkel, it also retards expulsion of water which enters the snorkel during a dive below the water surface. The significant increase in respiratory and purging effort limits its utility and subsequent popularity.

U.S. Pat. No. 2,317,236 entitled Breathing Apparatus for Swimmers, issued to C. H. Wilen, et al, on Apr. 20, 1943, teaches a valve with a buoyant ball arranged to block the above water end of the snorkel whenever water starts to enter. Such valves are bulky, often fail to seal and, also, significantly increase respiratory effort. Although once popular, such devices are presently considered unreliable and obsolete.

An open snorkel conduit will be completely flooded with water when a skin diver returns to the surface after swimming or diving underwater. The open end of the snorkel is above the water surface when the skin diver assumes the face down, surface swimming attitude. With the open end of the snorkel above the water surface, the conduit is purged for respiration by exhaling an explosive blast of air into the mouthpiece.

Surface tension forms the purging blast of air into a bubble which spans the cross section of the conduit. Pressure within the bubble expands the bubble toward the open end of the snorkel conduit. As the leading surface of the bubble moves away from the mouthpiece, the bulk of the water within the conduit is pushed ahead of the bubble and out the open end.

The purging bubble of air will slip past water which adheres to the inner surface of the conduit. After the purging air bubble is spent, residual water will flow down the inner surface toward the mouthpiece. Also, water which splashes into the open end of the snorkel conduit due to swimming movements or wave action will typically strike and adhere to the inner surface of the conduit and thereafter flow toward the mouthpiece. Water accumulates at the lowermost portion of the snorkel conduit, typically under the mouthpiece, and obstructs the conduit. Unless the conduit is completely blocked, a slow and cautious inhalation is possible after which another purging exhalation can be made.

The respiratory effort needed to purge a snorkel is significant. Many skin divers lack the respiratory strength needed to completely purge the snorkel with a single exhalation, and must repeat the purging procedure several times. Also, water will sometimes enter the snorkel just as the diver has completed an exhalation, leaving very little air in the lungs to satisfactorily complete a purge. Consequently, a means which decreases the respiratory effort and the amount of air required to purge a snorkel will be very beneficial.

A popular solution places an externally directed purge valve in the wall of the snorkel conduit at a location near the snorkel mouthpiece. Water in the flooded conduit which extends above the ambient water surface will drain through the purge valve. Because the total volume of water in the flooded snorkel is reduced by water flow through the purge valve, the respiratory effort required to purge the remaining water is also reduced.

Unfortunately, a purge valve also provides an alternate path for forcefully exhaled air. A purge valve located close to the mouthpiece will quickly and wastefully dissipate the explosive blast of purging air. One solution to this problem places the purge valve at a location approximately midway between the mouth opening and the open end of the snorkel conduit.

At mid-length of the snorkel conduit, the purge valve will be close to the ambient water surface when the skin diver is swimming face down on the water surface. At such a location, the purge valve will drain that portion of the snorkel conduit which extends above the water surface, but will not initially interfere with the purging blast of air. Even at this location, the purge valve will dissipate the forcefully exhaled air and the amount of residual water adhering to the inner surface of the conduit between the purge valve and the open end will be substantial. The residual water subsequently accumulates at the lowermost portion of the snorkel conduit and obstructs the conduit. Consequently, the purge valve by itself, even when located mid-length of the snorkel conduit, is of limited benefit.

U.S. Pat. No. 4,278,080 entitled Diving Snorkel, issued to Joseph N. Schuch on July 14, 1981, teaches a purge valve located at the bottom of a branch conduit which joins the snorkel conduit at a location approximately midway between the mouthpiece and the open end. The purge valve drains the snorkel conduit until the water level within the conduit matches the ambient water level. Part of the purging air will divert into the branch conduit and force water within the branch conduit out the purge valve. Schuch teaches that the branch conduit must have sufficient length to provide the transient resistance necessary to allow purging of the snorkel conduit before the purging air reaches and is dissipated by the purge valve.

Water within the snorkel conduit of Schuch is pushed out the open end before the purging air clears the branch conduit of water and reaches the purge valve.

Nevertheless, diverting part of the purging bubble of air into a branch conduit abates the driving pressure within the purging bubble and allows significant residual water to adhere to the upper portion of the snorkel conduit. Consequently, although the snorkel configuration of Schuch somewhat reduces the effort required to purge a flooded snorkel, it does not decrease the amount of purging air required, and it does not reduce residual water which adheres to the snorkel conduit wall and soon flows down the wall to obstruct the snorkel conduit near the mouthpiece. Also, the branch conduit adds significantly to the size of the snorkel, making the snorkel unwieldy in use.

In view of the foregoing factors, conditions and problems which are characteristic of the prior art, an improved skin diving snorkel is needed. Water should purge from the improved snorkel with a minimum of respiratory effort and without a wasteful loss of purging air. Also, small amounts of water which accumulate inside the improved snorkel after splashing in the open end, and water remaining after a purging exhalation, should not obstruct the airway. The improved snorkel should be compact and easy to use. The present invention satisfies all of these requirements.

SUMMARY OF THE INVENTION

The present invention is an improved skin diving snorkel having a conduit with an unobstructed, open end above water and an underwater end which terminates in a chamber. The chamber houses a normally closed float valve in series with an outwardly directed purge valve. The purge valve allows water in the snorkel to flow to ambient when hydrostatic pressure within the snorkel is greater than ambient. The chamber also serves to accumulate water which drains down the conduit after a purging exhalation or after splashing in the open end. A mouthpiece adjacent and above the chamber provides a flow path from the conduit to the interior of the diver's mouth.

The float valve opens when the chamber is flooded with water. Consequently, water in the snorkel which extends above the ambient water surface will drain through the purge valve, decreasing the amount of water remaining within the snorkel to be purged. The float valve blocks flow through the purge valve when the chamber is emptied of water during a purging exhalation, preventing the wasteful loss of purging air. Water which accumulates in the chamber between purges is eliminated when the snorkel is next purged.

DESCRIPTION OF THE DRAWINGS

A detailed description of the invention is made with reference to the accompanying drawings wherein like numerals designate corresponding parts in the several Figures.

DESCRIPTION OF THE PREFERRED EMBODIMENT

The following detailed description is of the best presently contemplated modes of carryiing out the invention. This description is not to be taken in a limiting sense, but is made merely for purposes of illustrating the general principles of the invention.

Figure 1:
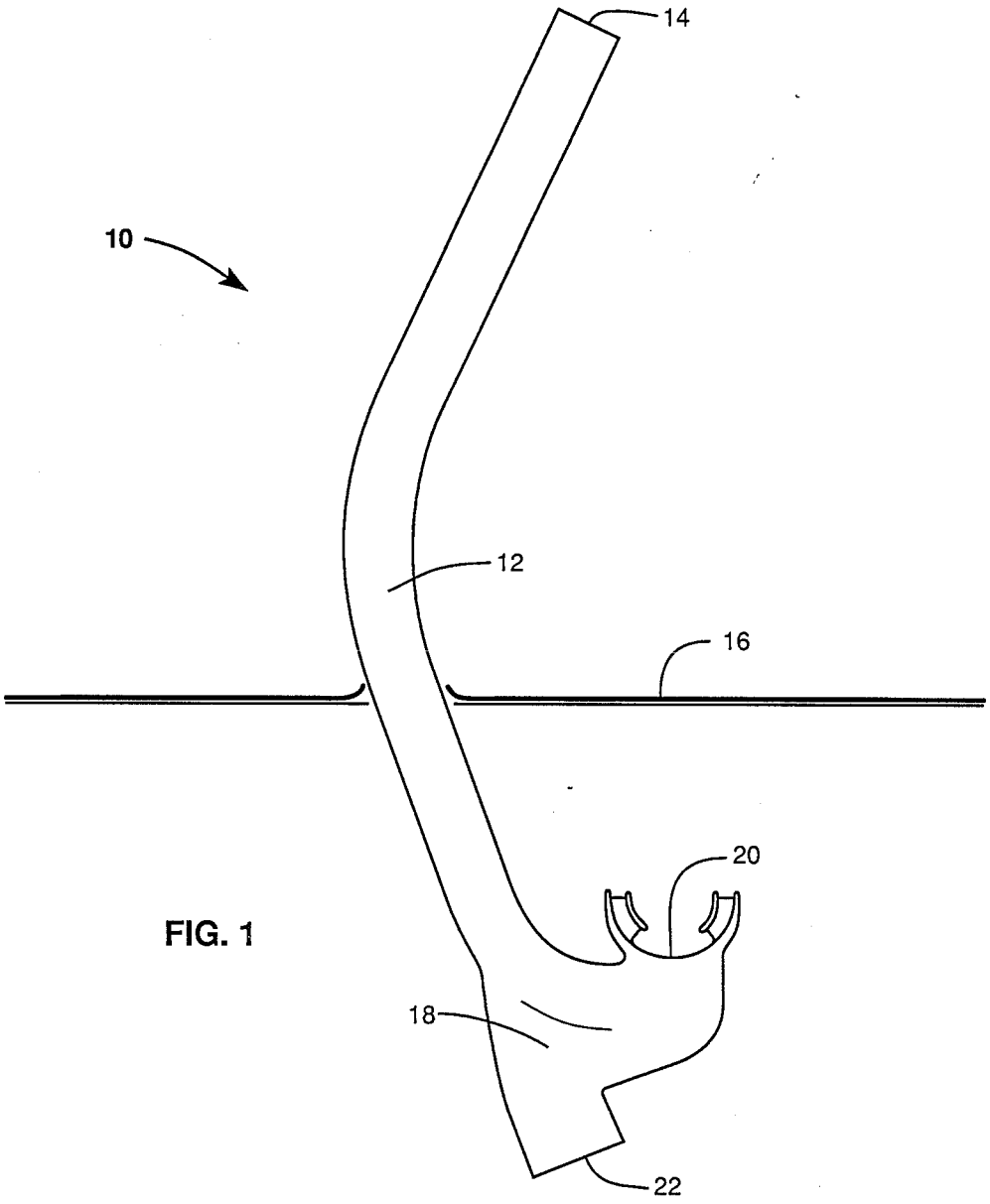
FIG. 1 is a front elevation view of a snorkel which has been constructed in accordance with the principles of the present invention, and which is pictured in the approximate position of use by a skin diver swimming face down on the water surface.
Figure 2:
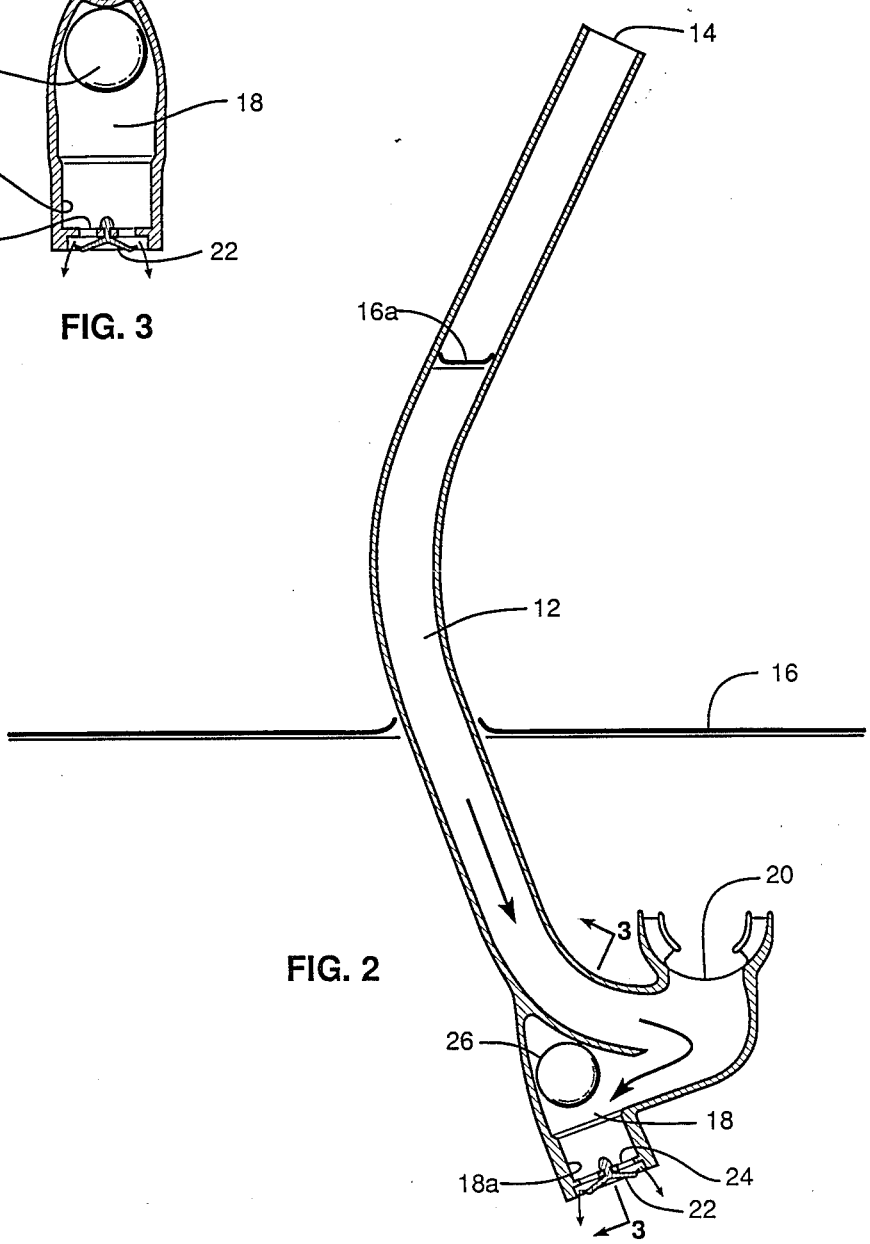
FIG. 2 is a longitudinal sectional view of the snorkel of FIG. 1, shown flooded with that portion above the water surface draining to ambient.

Referring to FIGS. 1 and 2, improved snorkel 10 is pictured in the approximate position of use by a skin diver swimming face down on the water surface. (For clarity the diver's head is not pictured in the FIGS.) Snorkel 10 includes a conduit 12 having an end with openinig 14 which extends into the air above ambient water surface 16. Air and water can freely enter and exit conduit 12 because opening 14 is unobstructed and provides fluid flow there thru with little or no resistance. The lower end of conduit 12 opens into chamber 18.

Upward opening mouthpiece 20, adjacent and above chamber 18, branches from the side of conduit 12. Mouthpiece 20 is adapted to be held by the mouth of the diver and provides a flow path from conduit 12 to the interior of the mouth. (In the FIGS., the opening of mouthpiece 20 should be considered covered by the diver's mouth.)

Conduit 12 can be configured to approximately match the curvature of the diver's head. The upper portion of conduit 12 can curve smoothly to place opening 14 approximately over the center of the head. Alternately, the upper portion of conduit 12 is straight.

Respiration and purging are facilitated by providing a substantially smooth flow path which is free of abrupt changes in path direction. While not so limited, the curvature may, for example, follow an elliptical path.

Figure 4:
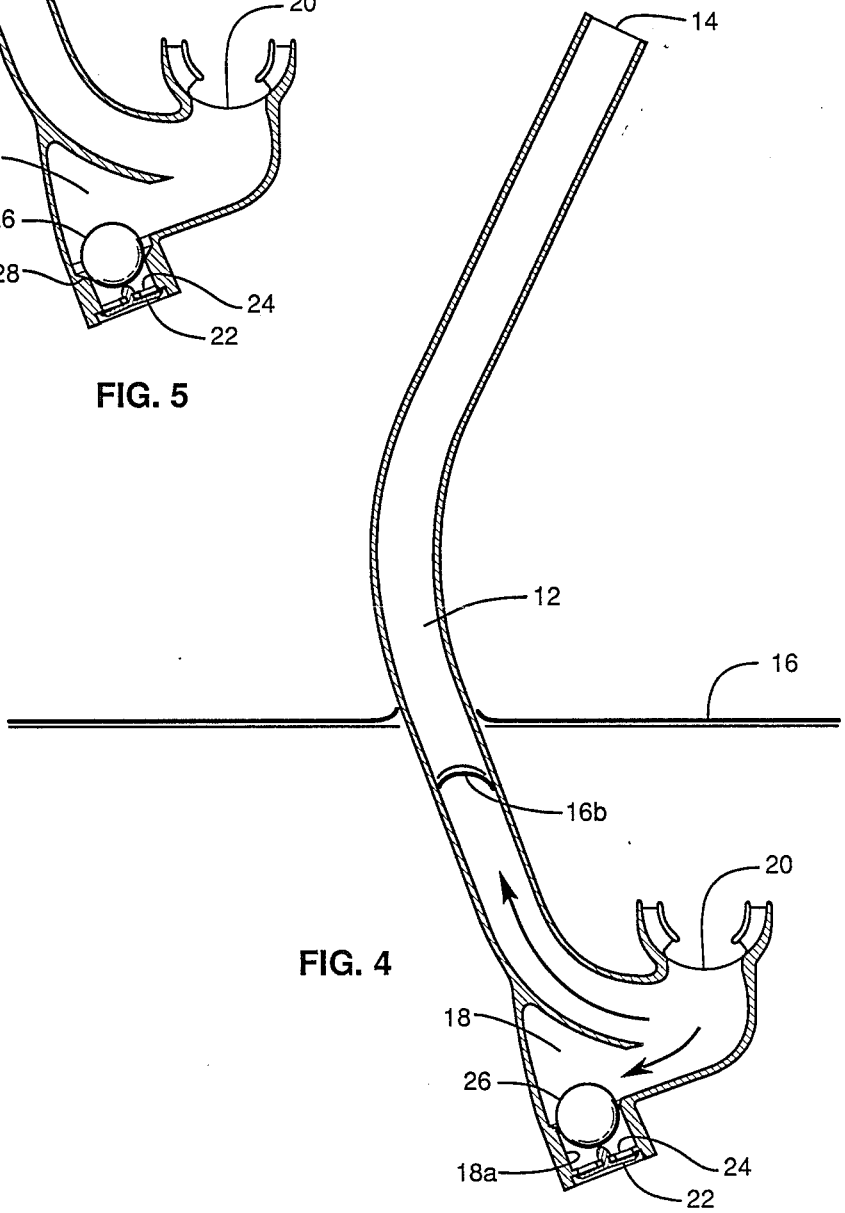
FIG. 4 is a view similar to FIG. 2, showing the snorkel during a purging exhalation.

Referring to FIGS. 2 and 4, purge valve 22 is located at the bottom of chamber 18. Purge valve 22 is oriented to allow water to flow from chamber 18 to ambient through purge valve opening 24.

Purge valve 22 is, typically, a flexible diaphragm of a resilient material, for example silicon elastomer or the like, which is restrained in such a way that it can selectively flex away from valve opening 24 which it covers. The diaphragm will flex under slight pressure to allow flow through valve opening 24 in one direction only. Reverse pressure forces the diaphragm to seal closed against valve opening 24. Consequently, purge valve 22 will prevent the reverse flow of ambient water into chamber 18 and subsequently conduit 12.

Figure 3:
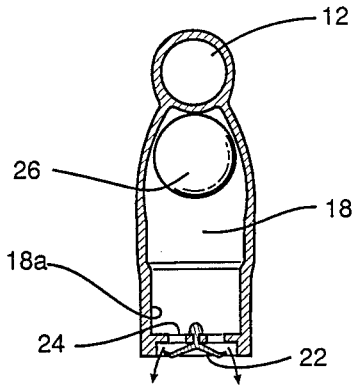
FIG. 3 is a partial sectional view of the snorkel, taken along a curved surface corresponding to line 3—3 of FIG. 2.

Buoyant member 26 is loosely restrained and moves freely within the confines of chamber 18. When chamber 18 is flooded with water, buoyant member 26 is buoyed away from purge valve opening 24 to the top of the chamber, (as shown in FIGS. 2 and 3). Although the shape and size of chamber 18 is not critical, when buoyant member 26 is buoyed to the top of chamber 18, the clearance under or around buoyant member 26 must be sufficient for water to flow without resistance to purge valve opening 24.

Buoyant member 26 has a specific gravity which provides buoyancy sufficient to counter the downward force of water flow through chamber 18 to purge valve opening 24. In addition, buoyant member 26 has structural strength adequate to resist compressive loading due to ambient water pressure at depths likely to be encountered by a diver.

Although other shapes may be utilized, mobile member 26 is spherical in the preferred embodiment. Correspondingly, chamber lower wall 18*a* is cylindrical and has a diameter only slightly larger than the diameter of buoyant member 26. When chamber 18 is not flooded with water, buoyant member 26 rests against the bottom of chamber 18 within the confines of wall 18*a* (as shown in FIG. 4). In the rest position, limited clearance between buoyant member 26 and chamber wall 18*a* cause substantial resistance to fluid flow past buoyant member 26.

Figure 5:
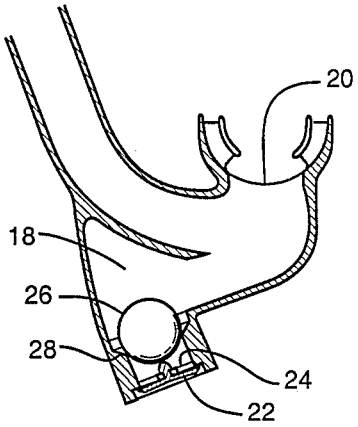
FIG. 5 is a partial sectional view of the snorkel of FIG. 1 showing an alternate internal configuration.

Other flow blocking configurations are possible because the shape of chamber 18 is not critical. For example, referring to FIG. 5, there is shown an alternate configuration in which substantial resistance to fluid flow is provided when buoyant member 26 rests against conical seat 28.

When a skin diver swims or dives below the water surface, water will pour into conduit 12 through opening 14, completely flooding the snorkel. After the skin diver surfaces and assumes the face down, surface swimming attitude, water above ambient water surface 16 (depicted as having surface 16*a* in FIG. 2) will drain (depicted as arrows in FIG. 2) through purge valve 22 via chamber 18. Referring to FIGS. 2 and 3, the outflow of water has flexed purge valve 22 away from opening 24. The outflow of water through purge valve 22 is facilitated when valve opening 24 has a fluid flow area equal to or greater than that of the fluid flow area of conduit 12.

After surface 16*a* drops to the level of ambient surface 16, water remaining in conduit 12 and chamber 18 is purged by exhaling an explosive blast of air into mouthpiece 20. Surface tension forms the purging blast of exhaled air into a bubble which spans the cross section of conduit 12. Pressure within the bubble expands the bubble away from mouthpiece 20. Referring to FIG. 4, as leading surface 16*b* of the bubble moves away from mouthpiece 20, the bulk of water within conduit 12 is pushed ahead of the bubble and lifted toward opening 14. Similarly, the bubble expands into chamber 18, displacing the water downward and out purge valve 22.

In FIG. 4 a forceful exhalation (as represented by arrows) has partially purged the water from conduit 12. The purging air has also expanded into chamber 18, forcing the water in chamber 18 out purge valve 24. Consequently, the buoyant force holding buoyant member 26 near the top of chamber 18 has been removed and buoyant member 26 has dropped into the restricted diameter of chamber 18. Surface tension holds residual water within the limited clearance between buoyant member 26 and chamber wall 18*a*, effectively blocking the flow of purging air out purge valve 22. As a result, the air forcefully exhaled by the diver is unable to wastefully dissipate through purge valve 22.

The purging bubble of air will slip past water which adheres to the inner surface of conduit 12. Residual water which adheres to the inner surface of conduit 12, after the purging air bubble is spent, will flow into chamber 18. Also, water which splashes into opening 14, due to swimming movements or wave action or the like, will flow into chamber 18. In addition, drainage of fluids from the mouth has been facilitated by locating mouthpiece 20 above chamber 18. Because conduit 12 and mouthpiece 20 drain into chamber 18, an unobstructed airway between opening 14 and mouthpiece 20 is maintained.

Water accumulated by chamber 18 is eliminated through purge valve 22 when the snorkel is next purged. Chamber 18 is advantageously sized to hold residual water which remains after a purging exhalation and also to hold small amounts of water which occasionally splash into conduit 12 through opening 14. Empirical studies have determined that a chamber volume equivalent to ten percent (10%) of the snorkel's total internal volume is sufficient for this purpose.

Figure 7:
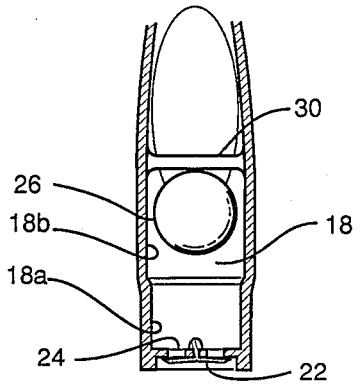
FIG. 7 is a partial sectional view of the snorkel, taken along a plane corresponding to line 7—7 of FIG. 6.
Figure 6:
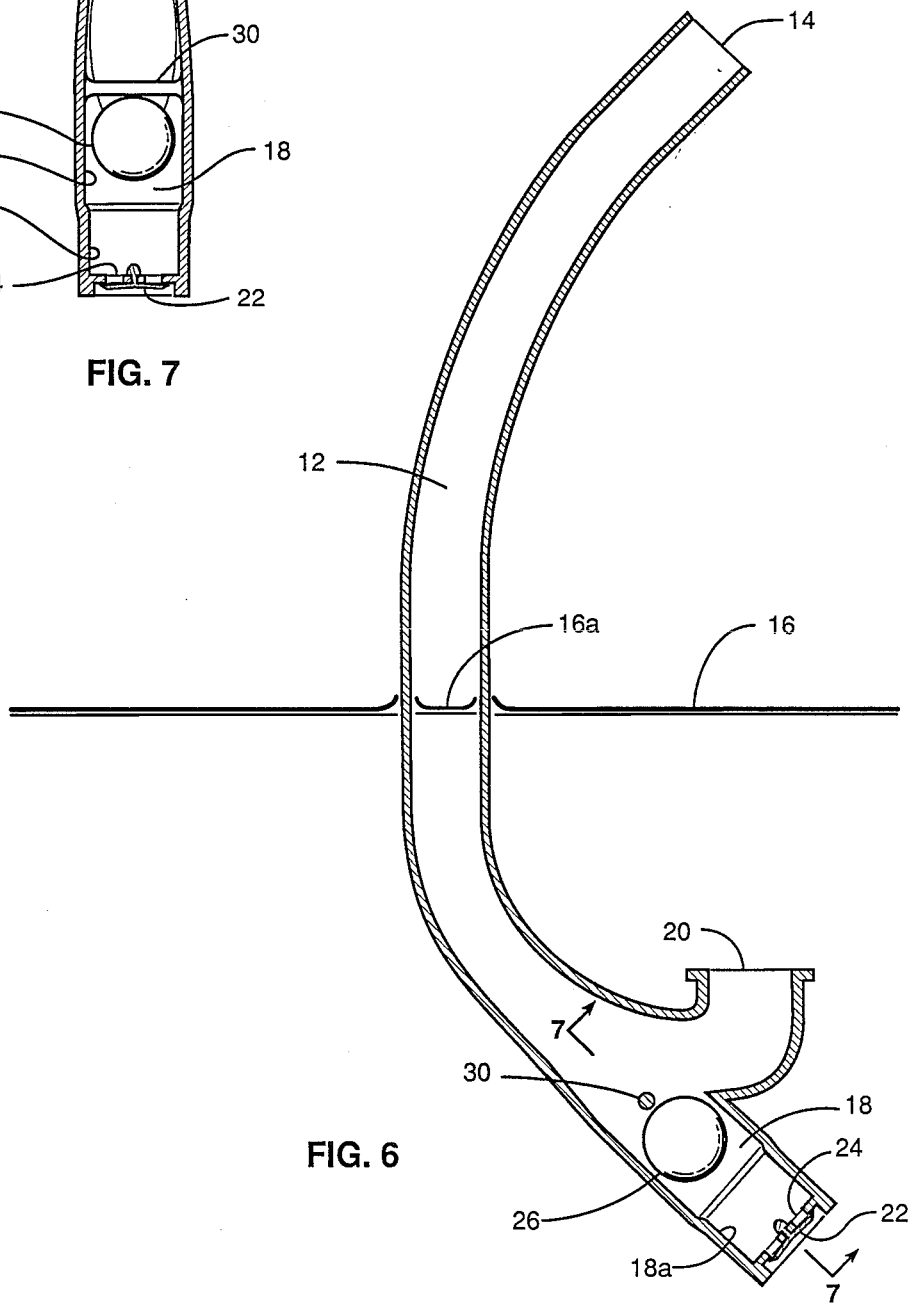
FIG. 6 is a longitudinal sectional view of an alternate snorkel configuration which has been constructed in accordance with the principles of the present invention, shown flooded to the level of the ambient water surface.
Figure 8:
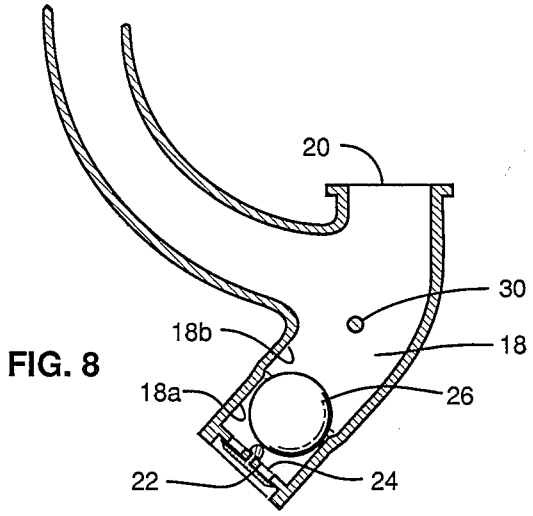
FIGS. 8 and 9 are partial sectional views of other snorkel configurations which have been constructed in accordance with the principles of the present invention.
Figure 9:
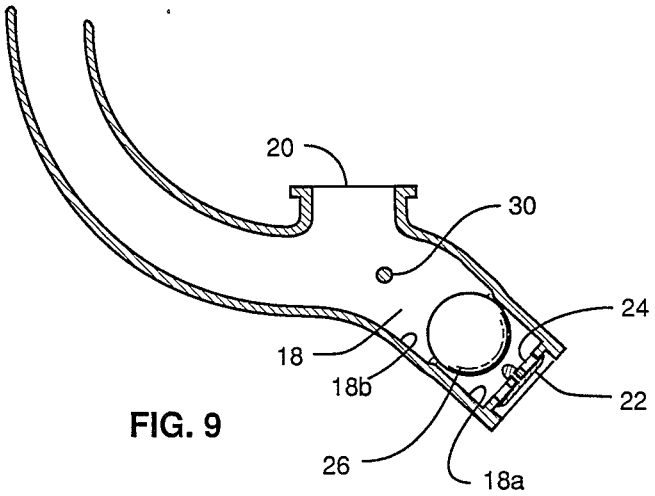

Referring to FIGS. 6, 8 and 9, there are shown alternate snorkel configurations which have been constructed in accordance with the principles of the present invention. Chamber 18 is shown as an enlarged cylindrical extension of conduit 12. Referring to FIG. 7, rod 30 disposed transverse to chamber 18, limits the upward movement of buoyant member 26 and prevents buoyant member 26 from moving into conduit 12. Other means of restraining buoyant member 26 can be conceived. For example, a grid of parallel bars or the like will serve the same function as rod 30.

When chamber 18 is flooded with water, buoyant member 26 is buoyed upward against rod 30 (as shown in FIGS. 6 and 7). The clearance between buoyant member 26 and chamber upper wall 18*b* must be sufficient for water to flow with little resistance past buoyant member 26 and out purge valve 22.

Thus, there is shown and described a snorkel having a conduit which has an open end above water and an underwater end which terminates in a chamber. The chamber houses a normally closed float valve in series with an outwardly directed purge valve. The chamber also serves to accumulate water which drains down the conduit after a purging exhalation or after splashing in the open end. A mouthpiece adjacent and above the chamber provides a flow path from the conduit to the interior of the diver's mouth. The snorkel is generally formed of a combination of suitable materials such as vinyl plastic and silicone elastomer or the like.

Variations on the diameters, shape and radius of curvature of the conduits and chamber are contemplated as are deviations from circular cross sections. Although the most advantageous location for chamber 18, with its serially incorporated buoyant member 26 and purge valve 22, is below mouthpiece 20 at the end of conduit 12, chamber 18 can be located anywhere along the length of conduit 12.

It is understood that those skilled in the art may conceive of modifications and/or changes to the invention described above. Any such modifications or changes which fall within the purview of the description are intended to be included therein as well. This description is intended to be illustrative and is not intended to be limitative. The scope of the invention is limited only by the scope of the claims appended hereto.

I claim:

1. A snorkel device comprising:

a conduit having first and second ends thereof;

said first end of said conduit being open whereby it is unobstructed and freely admits ambient fluid into said conduit;

mouthpiece means joined to said second end of said conduit and communicating fluid flow with said conduit;

a chamber having a first opening into said conduit, and an ambient opening;

said first opening of said chamber communicating fluid flow with said conduit;

purge valve means disposed at said ambient opening of said chamber, said purge valve means arranged to selectively provide unidirectional flow from said chamber to ambient; and a mobile member situated in said chamber, said mobile member substantially blocking fluid flow to said purge valve means when water is not flooding said chamber.

2. The snorkel device recited in claim 1 wherein:

said mobile member is spherically shaped.

3. The snorkel device recited in claim 1 wherein:

said mobile member has a specific gravity which provides buoyancy in water.

4. The snorkel device recited in claim 1 including:

restraining means adjacent said first opening of said chamber, said restraining means maintaining said mobile member within said chamber.

5. The snorkel device recited in claim 4 wherein:

said restraining means comprises a rod transverse to said chamber.

6. The snorkel device recited in claim 1 wherein:

said purge valve means includes flexible diaphragm means mounted to selectively open under pressure thereby to permit unidirectional flow from the interior of said chamber to ambient.

7. The snorkel device recited in claim 1 wherein:

said purge valve means has a fluid flow area at least equal to the fluid flow area of said conduit.

8. The snorkel device recited in claim 1 wherein:

said conduit defines a substantially smooth flow path between said first end of said conduit and said mouthpiece means.

9. The snorkel device recited in claim 1 wherein:

said chamber provides flow restricting clearance with said mobile member when said mobile member is adjacent said ambient opening of said chamber.

10. The snorkel device recited in claim 1 wherein:

said chamber incorporates seat means adjacent said ambient opening of said chamber, and said seat means forms a substantially flow blocking closure with said mobile member when said mobile member is resting against it.

11. The snorkel device recited in claim 10 wherein:

said seat means comprises a conical shelf.

12. The snorkel device recited in claim 1 wherein:

said chamber is disposed below said mouthpiece means.

13. The snorkel device recited in claim 1 wherein:

said chamber is intermediate said first end of said conduit and said mouthpiece means.

14. The snorkel device recited in claim 12 wherein:

said chamber has an internal volume at least equivalent to ten percent (10%) of the total internal volume of said snorkel device.

15. A snorkel device comprising:

a conduit having a top end which is open and unobstructed and freely admits ambient fluid into said conduit;

a chamber having an upper opening joined to and communicating fluid flow with said conduit;

said chamber having a lower opening;

purge valve means disposed at said lower opening of said chamber, said purge valve means arranged to selectively provide unidirectional fluid flow from said chamber to ambient;

a buoyant member moveably situated in said chamber;

said buoyant member substantially restricts fluid flow through said chamber to said purge valve means when said buoyant member is located adjacent said chamber lower opening;

said buoyant member is selectively buoyed away from said chamber lower opening to provide substantially unrestricted fluid flow through said chamber to said purge valve means when said chamber is flooded with water; and mouthpiece means open to communicate fluid flow with the interior of said conduit.

* * * * *